US011643828B2

(12) United States Patent
Black et al.

(10) Patent No.: US 11,643,828 B2
(45) Date of Patent: May 9, 2023

(54) SUPPORT APPARATUS

(71) Applicant: Oxford Safety Components Limited, Oxford (GB)

(72) Inventors: John Alexander Black, Oxford (GB); David Robert Black, Oxford (GB)

(73) Assignee: Oxford Safety Components Limited, Oxford (GB)

( * ) Notice: Subject to any disclaimer, the term of this patent is extended or adjusted under 35 U.S.C. 154(b) by 248 days.

(21) Appl. No.: 16/755,354

(22) PCT Filed: Oct. 12, 2018

(86) PCT No.: PCT/GB2018/052938

§ 371 (c)(1),
(2) Date: Apr. 10, 2020

(87) PCT Pub. No.: WO2019/073255

PCT Pub. Date: Apr. 18, 2019

(65) Prior Publication Data

US 2021/0198907 A1 Jul. 1, 2021

(30) Foreign Application Priority Data

Oct. 13, 2017 (GB) ..... 1716844

(51) Int. Cl.
*E04G 1/28* (2006.01)
*E04G 1/15* (2006.01)
(Continued)

(52) U.S. Cl.
CPC ..... *E04G 1/28* (2013.01); *E04G 1/15* (2013.01); *E04G 1/22* (2013.01); *E04G 1/24* (2013.01);
(Continued)

(58) Field of Classification Search
CPC .... E04G 1/28; E04G 5/02; E04G 7/00; E04G 2001/157; E04G 25/04; E04G 2025/006;
(Continued)

(56) References Cited

U.S. PATENT DOCUMENTS 3,096,536 A * 7/1963 Rabelos ..... B60B 33/06 16/24
3,139,951 A * 7/1964 Clayton ..... E04G 1/34 182/186.2
(Continued)

FOREIGN PATENT DOCUMENTS

CN 205777411 U 12/2016
EP 1783302 A2 5/2007
(Continued)

OTHER PUBLICATIONS

Combined Search and Examination Report for corresponding Application No. GB1716844.4 dated Mar. 9, 2018, 7 pages.
(Continued)

*Primary Examiner* — Brian D Mattei
*Assistant Examiner* — Kathleen M. McFarland
(74) *Attorney, Agent, or Firm* — Seyfarth Shaw LLP

(57) ABSTRACT

A support apparatus 1 for supporting a user in an elevated working position above a ground surface G comprises a frame 60 for supporting a floor portion 20 of the support apparatus and a plurality of leg members 40*a*, 40*b* mounted to the frame 60 for supporting the frame above the ground surface G. Each leg member has a foot portion 42 for engaging the ground surface G. Each leg member is rotatably mounted to the frame for rotation about a rotational axis which is substantially perpendicular to the width and the length of the frame and each leg member extends from the frame in a radial direction of the rotational axis, whereby the foot portion is offset from the rotational axis.

10 Claims, 13 Drawing Sheets

(51) Int. Cl.

| | |
|---|---|
| ***E04G 1/22*** | (2006.01) |
| ***E04G 1/24*** | (2006.01) |
| ***E04G 1/36*** | (2006.01) |
| ***E04G 5/02*** | (2006.01) |
| ***E04G 5/14*** | (2006.01) |
| ***E04G 7/00*** | (2006.01) |

(52) U.S. Cl.
CPC ..... *E04G 1/365* (2013.01); *E04G 5/02* (2013.01); *E04G 5/142* (2013.01); *E04G 7/00* (2013.01); *E04G 2001/157* (2013.01); *E04G 2001/242* (2013.01); *E04G 2001/248* (2013.01)

(58) Field of Classification Search
CPC ..... E04G 3/28; A47B 3/08; A47B 2003/025; A47B 9/20; A47B 2013/022; F16M 11/24
See application file for complete search history.

(56) References Cited

U.S. PATENT DOCUMENTS

| | | | | | |
|---|---|---|---|---|---|
| 3,216,048 | A * | 11/1965 | Jespersen | B60B 33/08 | 16/37 |
| 3,441,974 | A * | 5/1969 | Hollie | A47B 91/028 | 16/33 |
| 3,547,054 | A * | 12/1970 | Caldwell | A47B 3/0815 | 108/115 |
| 4,043,277 | A * | 8/1977 | Wallace | A47C 4/20 | 248/188.5 |
| 4,078,633 | A * | 3/1978 | Fahy | E04G 3/265 | 182/229 |
| 4,457,402 | A * | 7/1984 | Del Vecchio | B66B 9/0869 | 105/449 |
| 5,388,663 | A * | 2/1995 | Phillippe | E04G 17/002 | 248/246 |
| 5,860,489 | A * | 1/1999 | Krause | E04G 1/24 | 182/17 |
| 6,536,358 | B1 * | 3/2003 | Fears | A47B 3/08 | 108/116 |
| 6,959,785 | B1 * | 11/2005 | Chilton | E06C 1/39 | 248/188.5 |
| 7,686,134 | B1 * | 3/2010 | Harris | E06C 7/426 | 182/222 |
| 8,651,031 | B1 * | 2/2014 | Pazhoor | E04H 1/1255 | 108/115 |
| 8,827,386 | B1 * | 9/2014 | Kennard | A47B 77/10 | 312/277 |
| 10,030,447 | B2 * | 7/2018 | Pyros | E04G 1/18 | |
| 2004/0103828 | A1 * | 6/2004 | Maier | A47B 3/0812 | 108/125 |
| 2006/0169539 | A1 * | 8/2006 | Grebinoski | E04G 1/15 | 182/223 |
| 2010/0071996 | A1 * | 3/2010 | Huang | E04G 1/34 | 182/118 |
| 2012/0234629 | A1 * | 9/2012 | Peters | E04G 1/365 | 182/151 |
| 2014/0261105 | A1 * | 9/2014 | Nafziger | A47B 21/0314 | 108/97 |
| 2016/0281917 | A1 * | 9/2016 | Murphy | A47B 96/06 | |
| 2017/0183881 | A1 * | 6/2017 | Yoo | E04G 1/34 | |
| 2017/0314329 | A1 * | 11/2017 | Pyros | E06C 7/44 | |
| 2019/0226217 | A1 * | 7/2019 | Foley | E04G 1/30 | |
| 2020/0015453 | A1 * | 1/2020 | Escalante | A47B 37/00 | |
| 2021/0100351 | A1 * | 4/2021 | Thomas | A47B 5/04 | |
| 2022/0095784 | A1 * | 3/2022 | Yang | A47B 3/10 | |

FOREIGN PATENT DOCUMENTS

| | | | |
|---|---|---|---|
| EP | 2599937 | A | 6/2013 |
| FR | 2663973 | A1 | 1/1992 |
| FR | 2675882 | A1 | 10/1992 |
| FR | 2928402 | A | 9/2009 |
| GB | 2536629 | A | 9/2016 |
| WO | 92/00432 | A2 | 1/1992 |
| WO | 204199651 | U | 3/2015 |
| WO | 103046729 | B | 10/2015 |
| WO | 2016151307 | | 9/2016 |

OTHER PUBLICATIONS

International Search Report for Application No. PCT/GB2018/052938 dated Dec. 13, 2018, 20 pages.
Written Opinion for Application No. PCT/GB2018/052938 dated Dec. 13, 2018, 8 pages.

* cited by examiner

SUPPORT APPARATUS

CROSS REFERENCE TO RELATED APPLICATIONS

This is a National Stage application of, and claims priority to, PCT/GB2018/052938, filed Oct. 12, 2018, which further claims priority to GB Patent Application No. 1716844.4, filed Oct. 13, 2017, the disclosures of which are incorporated herein by reference in their entirety.

This invention relates to a support apparatus, in particular a safety platform.

BACKGROUND

Our patent applications WO 2016/151307 and GB2536629 disclose an adjustable scaffold. The present invention, at least in preferred embodiments, seeks to develop the adjustable scaffold described therein.

BRIEF SUMMARY OF THE DISCLOSURE

In accordance with the present invention there is provided a support apparatus for supporting a user in an elevated working position above a ground surface. The support apparatus comprises a frame for supporting a floor portion of the support apparatus, the frame having a length and a width; and a plurality of leg members mounted to the frame for supporting the frame above the ground surface, each leg member having a foot portion for engaging the ground surface. Each leg member is rotatably mounted to the frame for rotation about a rotational axis which is substantially perpendicular to the width and the length of the frame, and each leg member extends from the frame in a radial direction of the rotational axis, whereby the foot portion is offset from the rotational axis.

Thus, in accordance with the invention rotation of the leg members about the rotational axis allows the foot portion of each leg member to be positioned to provide maximum stability with the flexibility to position the support apparatus as close to working surfaces, such as walls, as is required. In addition, the leg members can be rotated to minimise the total width of the support apparatus, so that the support apparatus can be moved through doors and the like.

At least a portion of each leg member may extend from the frame at an acute angle to the rotational axis. That portion of the leg member may be telescopically extensible. In this way, telescopic extension of the leg member increases both the height of the frame above the ground surface and the offset of the foot portion from the rotational axis. This is advantageous in that as the support apparatus is used at increasing height the effective footprint of the support apparatus increases to increase overall stability.

Each leg member may be pivotally mounted to the frame about a pivot axis transverse to the rotational axis. This allows the leg members to be folded against the frame for transport. A locking mechanism, for example comprising complementary holes and a locking pin, may be provided to lock the leg member in a working position.

The foot portion of each leg member may comprise a wheel member, for example a castor. The wheel member may be spring mounted within the foot portion, whereby the weight of a user on the frame causes the foot portion to engage the ground surface in preference to engagement of the ground surface by the wheel member. Alternatively, a locking mechanism may be provided for the wheel member.

The wheel members allow easy transportation of the support apparatus from one working location to another.

Each leg member may be rotatably mounted to the frame by the leg member being received within a collar. A locking mechanism, for example comprising complementary holes and a locking pin, may be provided to lock the leg member in a working position. The leg members may be removably received within the collars. In this way the leg members may be replaced optionally with alternative leg members. For example, straight leg members may be used to convert the support apparatus into a stairwell platform. The collar may be pivotally mounted to the frame about a pivot axis transverse to the rotational axis. The frame may be provided with a lip portion at an end thereof for engagement with a stair.

The frame may be telescopically extensible to increase the length thereof. The frame may be provided with a railing assembly. The railing assembly may be telescopically extensible to increase the length thereof with the extension of the frame.

The invention extends to a kit of parts for forming the support apparatus.

BRIEF DESCRIPTION OF THE DRAWINGS

Embodiments of the invention are further described hereinafter with reference to the accompanying drawings, in which.

DETAILED DESCRIPTION

Figure 1:
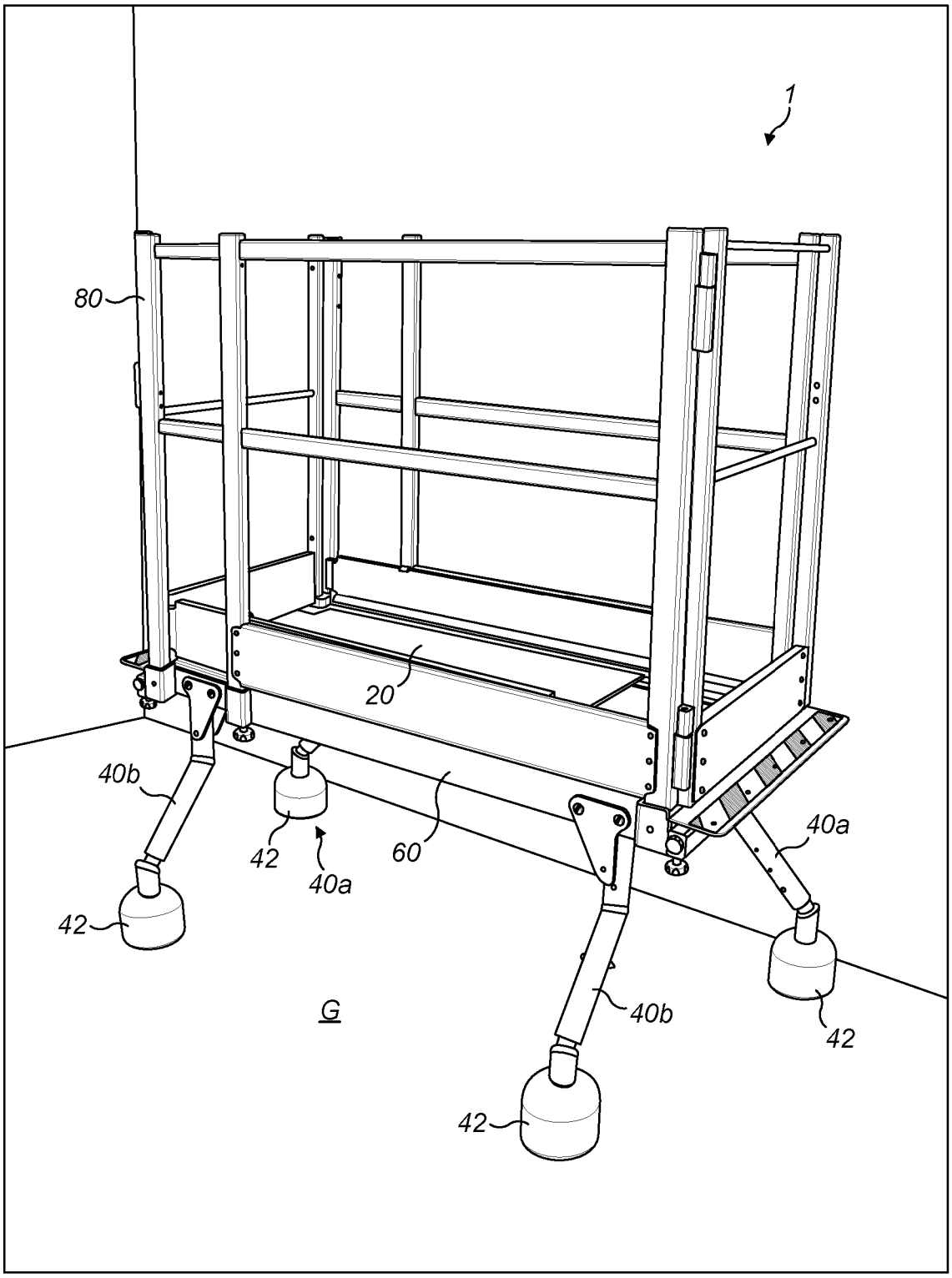
FIG. 1 is an illustration of a support apparatus according to an embodiment of the present invention, shown in a first configuration.

FIG. 1 is an illustration of a support apparatus according to an embodiment of the present invention, shown in a first configuration. The support apparatus 1 comprises a floor portion 20 configured to be supported off a ground surface G by a plurality of leg members 40*a*, 40*b*. In this example, a frame 60 is provided between the floor portion 20 and the plurality of leg members 40*a*, 40*b*. A safety barrier in the form of a railing assembly 80 extends upwardly from the floor portion 20 to substantially prevent inadvertent access or egress of a user of the support apparatus respectively to or from the floor portion 20.

The floor portion 20 provides a working surface for supporting the user and/or one or more tools of the user above the ground surface G. In this example, the working surface of the floor portion 20 is provided by a solid floor portion. The working surface is substantially horizontal in use. The operation and configuration of the floor portion 20 will be explained further with reference to FIG. 5 hereinafter.

The support apparatus 1 comprises four leg members 40*a*, 40*b*. The plurality of leg members 40*a*, 40*b* are each pivotably mounted relative to the floor portion 20, each about an axis of rotation in a direction away from the working surface of the floor portion 20. In this example, the axis of rotation about which the plurality of leg members 40*a*, 40*b* are pivotably mounted relative to the floor portion 20 is substantially transverse to the working surface. In other words, the axis of rotation is substantially vertical in use. The leg members 40*a*, 40*b* each comprise a foot portion 42 at a lower end of the leg member 40*a*, 40*b*, opposite an upper end of the floor portion 20. For each leg member 40*a*, 40*b*, the foot portion 42 is radially spaced from the axis of rotation of the leg member 40*a*, 40*b*. Thus, when one of the leg members 40*a*, 40*b* is rotated about the axis of rotation, the foot portion 42 moves along an arcuate path to a different position relative to the axis of rotation. In this example, a first pair of leg members 40*a* are each rotated such that they align with a length of the support apparatus 1. That is, the foot portion 42 of each of the first pair of leg members 40*a* extend substantially lengthways away from the frame 60. A second pair of leg members 40*b* are each rotated such that they align with a width of the support apparatus 1. That is, the foot portion 42 of each of the second pair of leg members 40*b* extend substantially width ways away from the frame 60. In this example, the leg members 40*a*, 40*b* are formed from steel for strength. In this example, the leg members 40*a*, 40*b* are also extendable to adjustably separate the foot portion 42 of the leg member 40*a*, 40*b* from the floor portion at the upper end of the leg member 40*a*, 40*b*.

The foot portion 42 may comprise a wheel member, for example a caster (not shown) for movement of the support apparatus 1 over the ground surface G. Other examples of a wheel member maybe a wheel, a roller, a ball or the like. In examples, the caster may be adjustably mounted within the foot portion 42 such that the caster can be raised or lowered whereby to allow or substantially prevent movement of the support apparatus 1 over the ground surface G in dependence on the protrusion of the caster out of the foot portion 42. In this example, the caster is connected to the foot portion via a spring, such that a sufficient load on the support apparatus 1 causes the foot portion 42 to engage with the ground surface G to substantially prevent free movement of the support apparatus 1 over the ground surface G. The spring in this example is configured to be operable by any load indicative of the weight of a user on the support apparatus 1. In this way, the support apparatus 1 cannot be easily moved whilst a user is on the floor portion 20. The leg members 40*a*, 40*b* will be explained further with reference to FIGS. 3 to 5 hereinafter.

The frame 60 is formed as an open frame defining a length and a width of the support apparatus 1. The frame 60 has each of the leg members 40*a*, 40*b* mounted thereto. The frame 60 is movable from a first configuration in which the frame 60 is provided in an unextended configuration (as shown in FIG. 1) into a second configuration in which the frame 60 is provided in an extended configuration. In the second configuration, it will be understood that the length of the frame 60 is greater than in the first configuration. In this example, the frame 60 is configured to be extensible by telescopic extension of a first portion of the frame 60 relative to a second portion of the frame 60. The floor portion 20 is directly supported on the frame 60. Thus, the weight of a user on the floor portion 20 is passed from the floor portion 20 to the frame 60, from the frame 60 to the upper end of the leg members 40*a*, 40*b* and through the leg members 40*a*, 40*b* to the foot portion 42 at the lower end of the leg members 40, and to the ground surface G. The frame 60 will be explained further with reference to FIG. 8 hereinafter.

The railing assembly 80 is mounted to the frame 60 and extensible therewith during movement of the frame 60 from the first configuration to the second configuration. The railing assembly 80 will be explained further with reference to FIG. 6 hereinafter.

In this example, the support apparatus 1 is arranged to provide the working surface of the floor portion 20 at a height of between 550 millimetres and 650 millimetres above the ground surface G.

Figure 2:
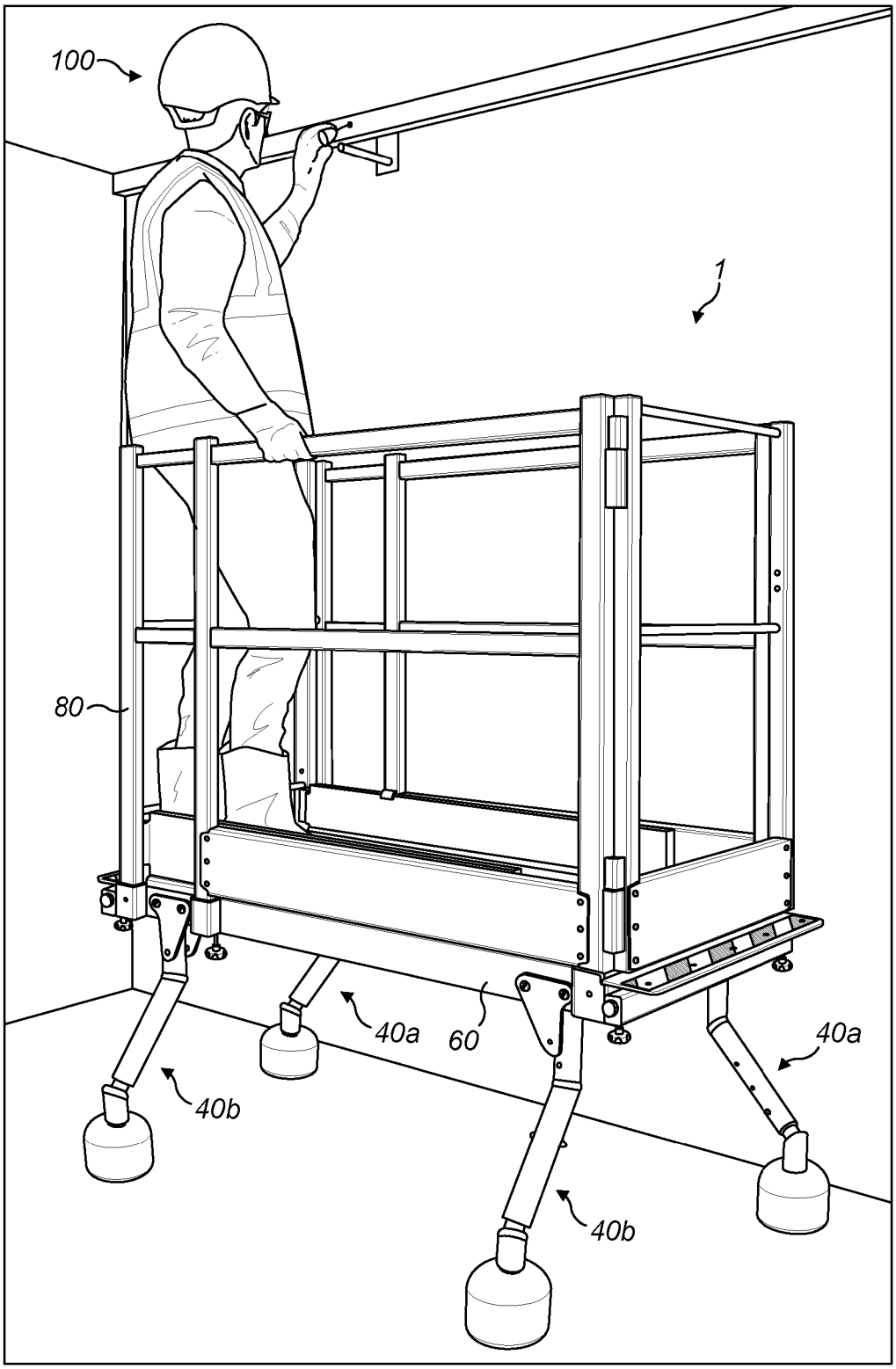
FIG. 2 is a further illustration of the support apparatus of FIG. 1, shown with a person supported thereon.

FIG. 2 is a further illustration of the support apparatus 1 of FIG. 1, shown with a user 100 supported thereon. The support apparatus 1 allows the user 100 to reach a task at height without unsafe reaching. The support apparatus 1 is substantially as described with reference to FIG. 1.

Figure 3:
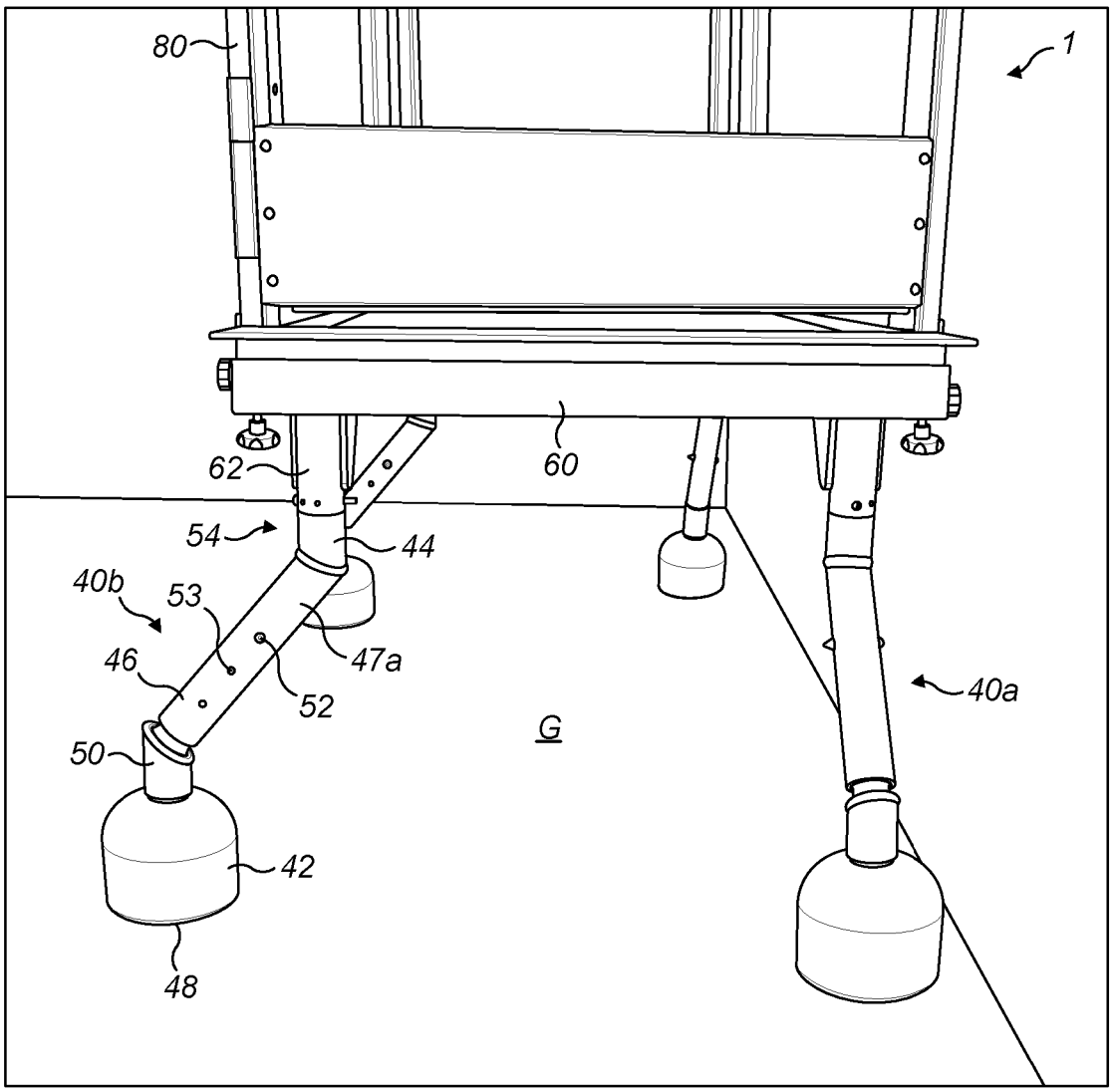
FIG. 3 is a yet further illustration of the support apparatus of FIG. 1.

FIG. 3 is a yet further illustration of the support apparatus of FIG. 1. FIG. 3 illustrates the leg members 40*a*, 40*b* in more detail. In particular, further detail regarding one of the second pair of leg members 40*b* will be described. It will be understood that the description of the features and functionality of the one of the second pair of leg members 40*b* can apply equally to either of the first pair of leg members 40*a*. In particular, the leg member 40*b* comprises a first portion 44 which extends in a first direction. The leg member 40*b* further comprises a second portion 46 extending from the first portion 44 in a second direction, different from the first direction. The foot portion 42 is connected to the first portion 44 of the leg member 40*b* via the second portion 46. In this example, the foot portion 42 is connected to the second portion 46 via a third portion 50. The third portion 50 extends in substantially the first direction. Thus, both the first portion 44 and the third portion 50 extend in substantially the same direction.

The foot portion 42 comprises a fixed foot 48 having an engaging surface to contact the ground surface G when sufficient force is applied to the support apparatus 1 as described hereinbefore. The foot portion 42 further comprises a wheel member (not shown) for selective engagement with the ground surface G for easy movement of the support apparatus on the ground surface G when a user is not present on the support apparatus 1 (for safety). In this example, the fixed foot 48 is in the form of a shell structure to substantially enclose the movement means. Thus, a user is protected from injury caused by trapping by the wheel member.

The first portion 44 is arranged to be received within a collar member 62 extending from the support frame 60. The first portion 44 and the collar member 62 are together provided with securing means in the form of a pin-connector 54 to secure the leg member 40*b* to the support frame 60 via the first portion 44 and the collar member 62 at one of a plurality of predetermined rotational positions. The axis of rotation of the leg member 40*b* extends through the collar member 62 and through the first portion 44. The first direction is substantially aligned with the axis of rotation. In this example, the second direction makes an angle of approximately 30 degrees with the first direction. Thus, the second portion 46 extends away from the first portion 44 at an angle of approximately 30 degrees from the first direction.

The first portion 44, the second portion 46, the third portion 50 and the fixed foot 48 are substantially formed from metal. In this example, the first portion 44, the second portion 46 and the third portion 50 are formed from tubular section. The second portion 46 provides an extensible member, such that a radial offset between the first portion 44 and the foot portion 42 can be adjusted by extension or retraction of the second portion 46. In examples where the second direction is different from 90 degrees from the first direction, extension or retraction of the second portion 46 also results in adjustment of a height of the working surface of the floor portion 20 relative to the ground surface G. In this example, a first component 47*a* of the second portion 46 is provided with a plurality of holes 53 defined therein for selective engagement by a protruding element 52 of a second component (not shown in FIG. 3) of the second portion 46. In this example, there are three holes 53, providing three different extension positions of the second portion 46 of the leg member 40*b*. The first component 47*a* of the second portion 46 is an elongate member arranged to have slidably received therein the second component of the second portion 46, the second component being a further elongate member having an outer diameter smaller than an inner diameter of the first component 47*a*. Thus, the leg member 40*b* is telescopically extensible.

Figure 4:
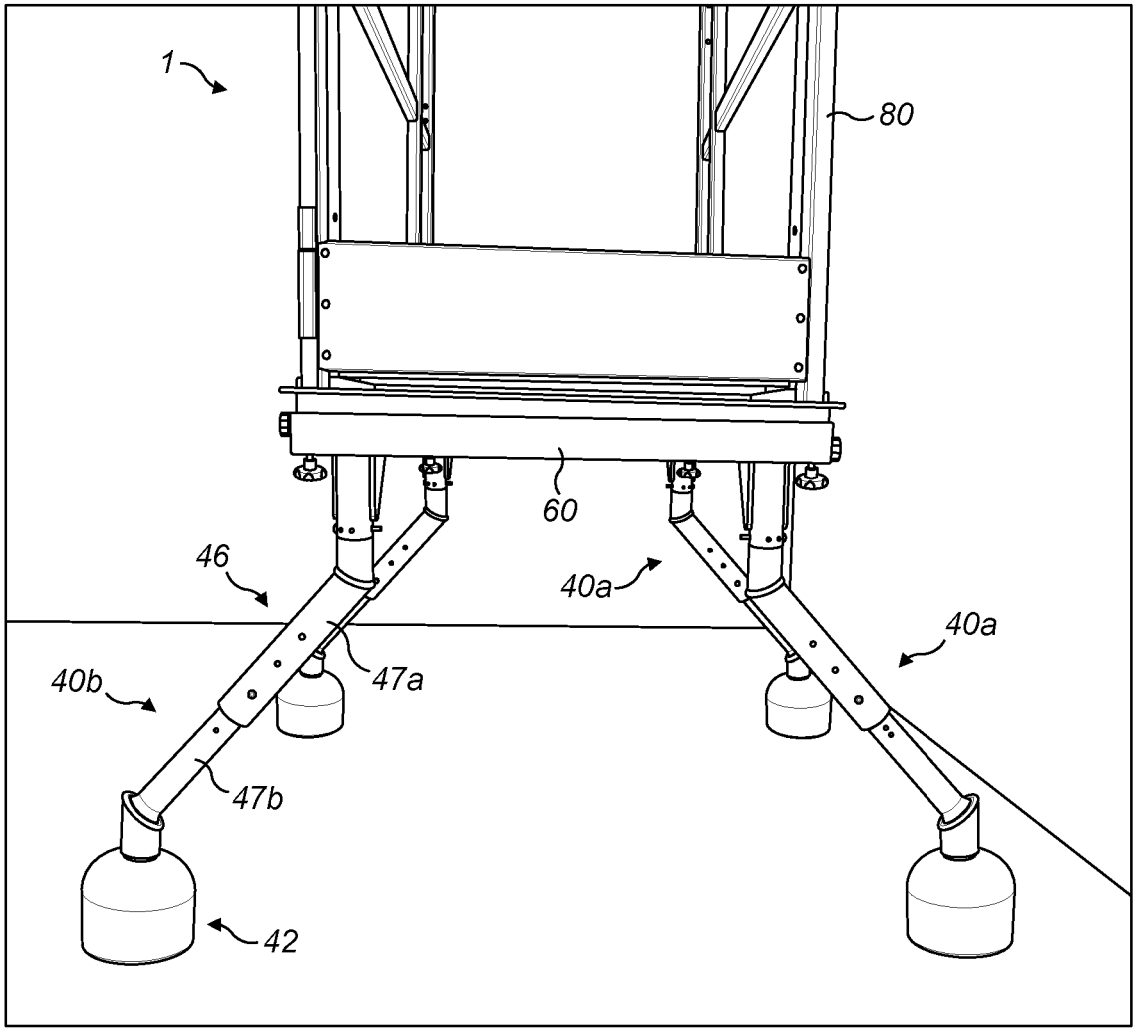
FIG. 4 is another illustration of the support apparatus of FIG. 1, shown in a further configuration.

FIG. 4 is another illustration of the support apparatus of FIG. 1, shown in a further configuration. In particular, FIG. 4 shows each of the leg members 40*a*, 40*b* in an extended configuration with the second component 47*b* of the second portion 46 secured in an extended position relative to the first component 47*a* of the second portion 46. It will be understood that the support apparatus 1 is both higher and more stable in the extended configuration since the foot portion 42 of the leg members 40*a*, 40*b* are separated from the frame 60 by a greater distance in both the direction of the axis of rotation and a direction transverse to the axis of rotation and substantially away from the frame 60. Further, it will be seen in the configuration shown in FIG. 4 that the first pair of leg members 40*a* have been rotated about their respective axes of rotation such that there are now in a corresponding configuration to the second pair of leg members 40*b*. That is, the first pair of leg members 40*a* are rotated such that they align with a width of the support apparatus 1. That is, the foot portion 42 of each of the first pair of leg members 40*a* extend substantially widthways away from the frame 60. Compared to the configuration shown in FIGS. 1 to 3, the configuration of the leg members 40*a* in FIG. 4 provides greater stability of the support apparatus. However, it will be noted that in the configuration of FIGS. 1 to 3, with the leg members 40*a* extending lengthways, rather than widthways from the frame 60, the support apparatus can be located close to a wall to allow the user to work on the wall without having to reach over from the support apparatus 1.

Figure 5:
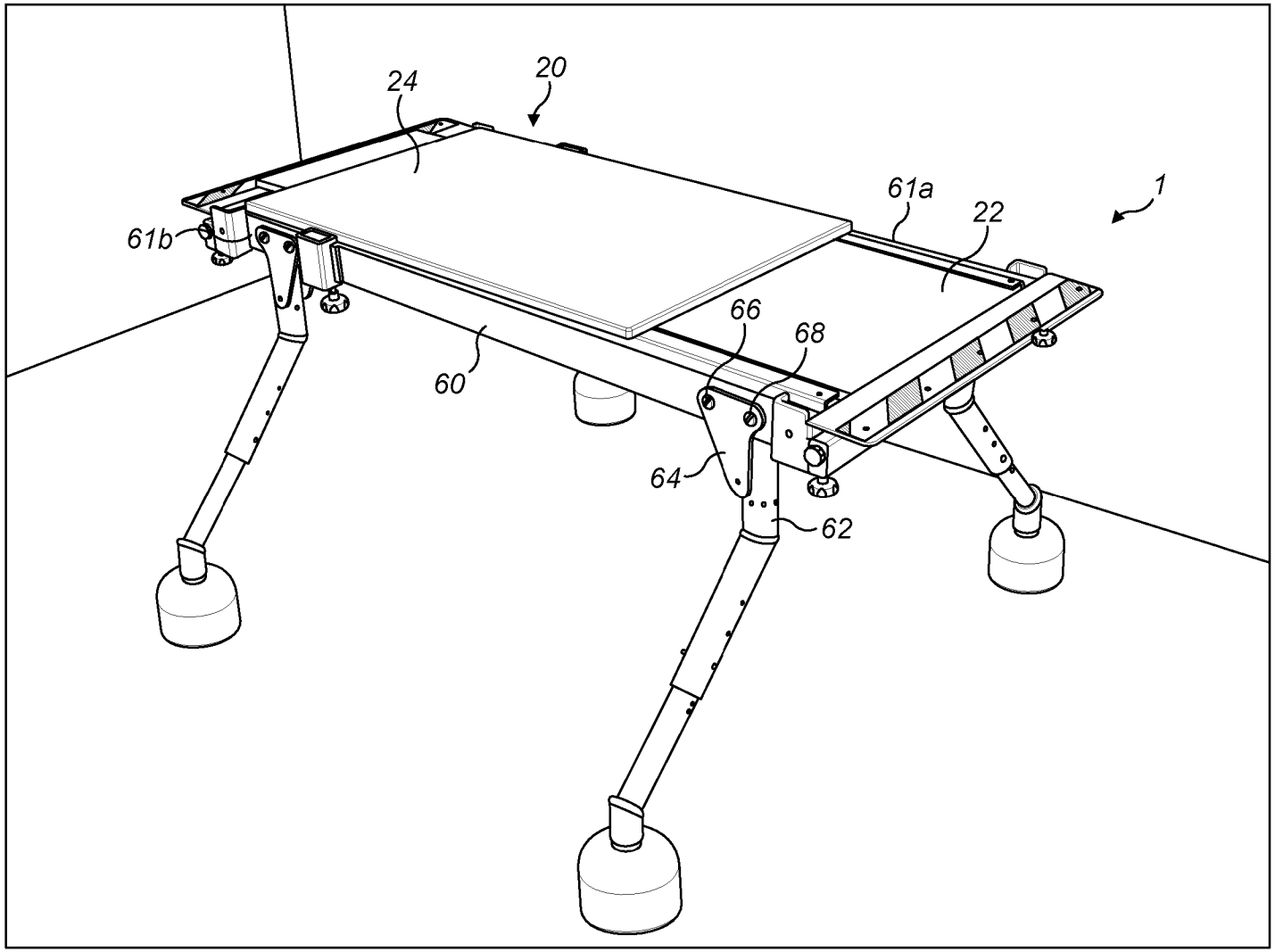
FIG. 5 is an illustration of the support apparatus as shown in FIG. 4, in the absence of a railing assembly.

FIG. 5 is an illustration of the support apparatus 1 as shown in FIG. 4, in the absence of a railing assembly 80. The frame 60 comprises a first portion 61*a* and a second portion 61*b*. The first portion 61*a* is movably mounted to the second portion 61*b*. In particular, the length of the frame 60 can be changed by movement of the first portion 61*a* relative to the second portion 61*b*. The first portion 61*a* is in the form of a first pair of side arms 61*a*, each for receiving therein one each of a second pair of side arms 61*b* providing the second portion 61*b*. One leg member 40*a*, 40*b* is mounted to each of the side arms 61*a*, 61*b*. The leg members 40*a*, 40*b* are mounted to the side arms 61*a*, 61*b* via the collar 62 for rotation about a pivot axis through a pivot pin 66. The pivot axis is parallel to the width of the frame 60. Thus, the leg members 40*a*, 40*b*, when pivoted about the pivot pin 66 can fold to lie flat against the frame 60. This is advantageous for the transportation of the support apparatus, for example in a van. To collar 62 comprises a flange plate 64 having a hole defined therein for passage of the pivot pin 66 therethrough. The flange plate 64 has further defined therein a further hole for passage therethrough of a locking pin 68. The leg members 40*a*, 40*b* can be secured in a deployed configuration where the leg members 40*a*, 40*b* extend downwards by engagement of the locking pin 68 through the further hole in the flange plate 64.

The frame 60 has supported thereon the floor portion 20. In particular, the floor portion 20 is provided by a first floor board 22 supported on the first portion 61*a* of the frame 60 and a second floor board 24 supported on the second portion 61*b* of the frame 60. In this example, the first floor board 22 is mounted for sliding under the second floor board 24 when the frame 60 is moved between the extended configuration and the unextended configuration. In this example, the floor board 22, 24 are formed from a wooden board. However, it will be understood that in other examples, the floor portion 20 may be provided by an openwork construction, for example an openwork lattice.

Figure 6:
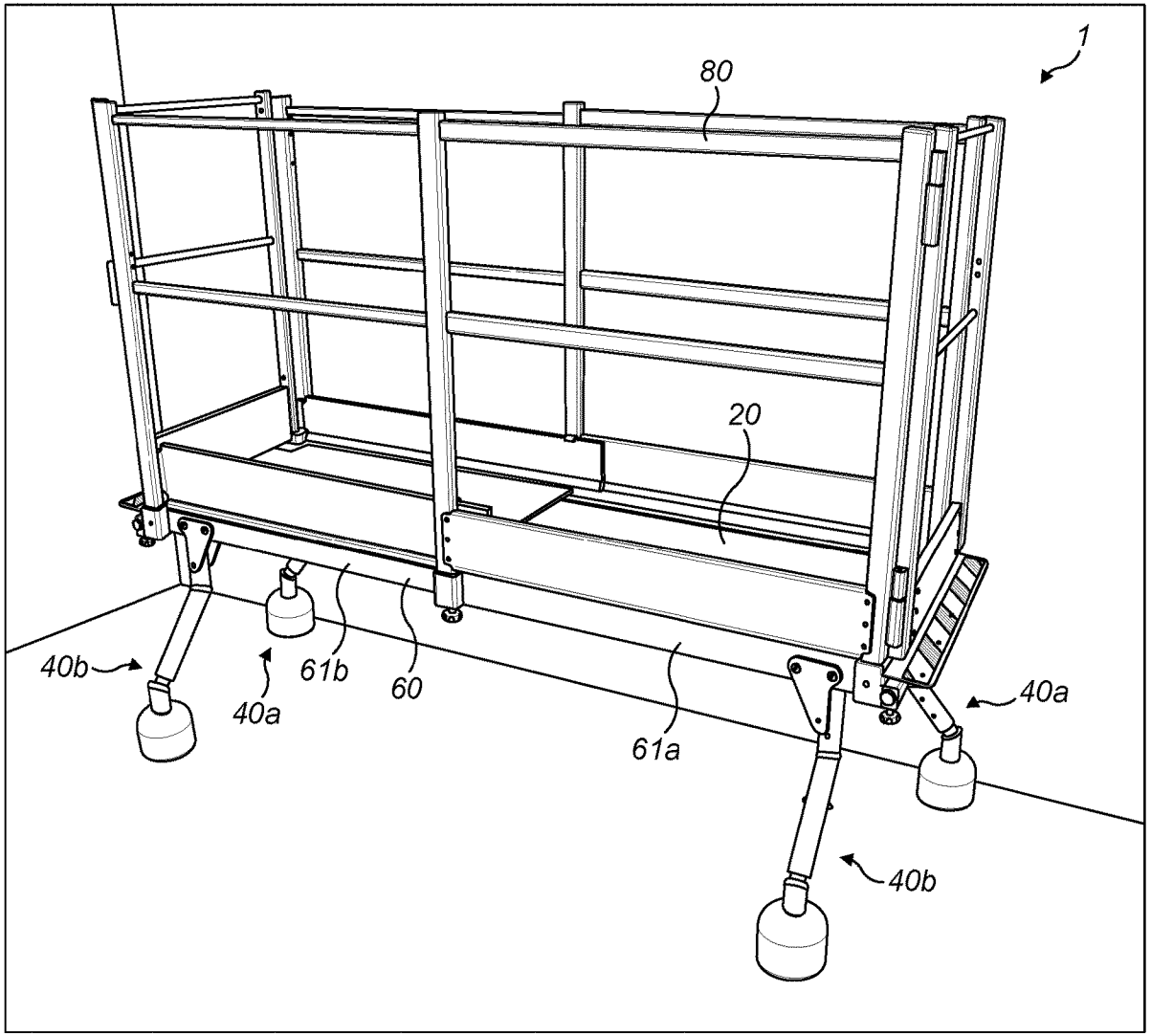
FIG. 6 is an illustration of the support apparatus of FIGS. 1 and 2, shown in an extended configuration.

FIG. 6 is an illustration of the support apparatus of FIGS. 1 and 2, shown in an extended configuration. In the extended configuration, the first portion 61*a* of the frame 60 is spaced from the second portion 61*b* of the frame 60. Furthermore, as will be appreciated from FIG. 6, the railing apparatus 80 is also in an extended configuration and continues to substantially prevent inadvertent access or egress of a user of the support apparatus 1 respectively to or from the floor portion 20, which is also extended. Thus, the support apparatus 1 can be easily resized to fit the available space, or for easy maneuvering through the available space.

Figure 7:
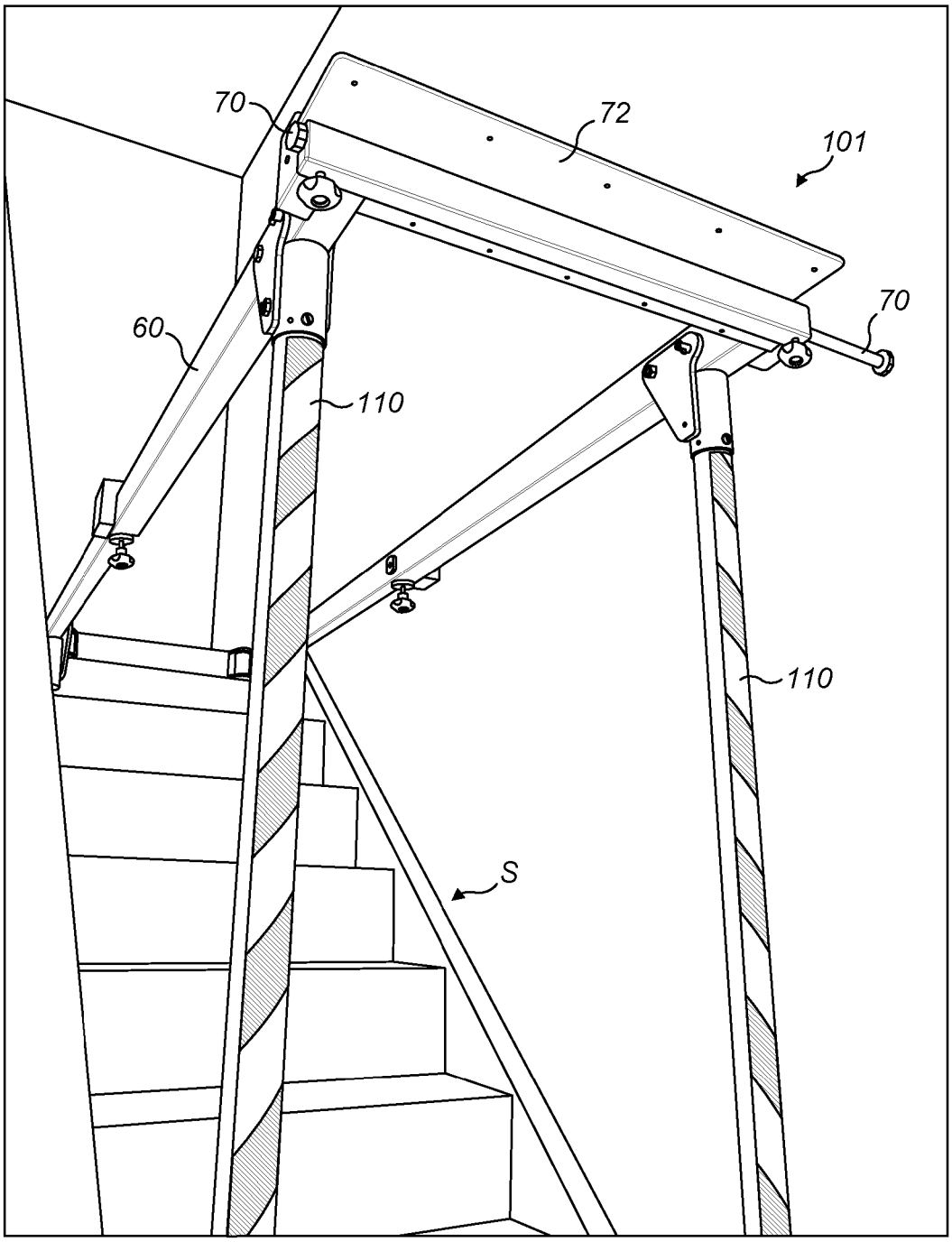
FIG. 7 is an illustration of a further support apparatus according to an embodiment of the present invention.

FIG. 7 is an illustration of a further support apparatus according to an embodiment of the present invention. In the embodiment shown in FIG. 7, the leg members 40*a*, 40*b* of the support apparatus 1 shown in the preceding Figures have all been removed from the frame 60 to be replaced by a different set of legs. In this particular example, the first portion 61*a* of the frame 60 of the support apparatus 1 has mounted thereto a pair of stairwell platform legs 110. The support apparatus 1 is thus transformed into a stairwell platform 101. The stairwell platform legs 110 are long enough to extend upwards from a set of stairs with the other end of the frame 60 supported on an upper step, for example at a top of the set of stairs S. In this example, the stairwell platform legs 110 are at least two metres in length. Thus, a level working platform can be provided above a set of stairs S. The open region defined by the frame 60 allows a user to assemble the stairwell platform 101, in particular the stairwell platform legs 110 whilst at a bottom of the set of stairs S, and then walk through the open region to install the floor portion 20 and the railing assembly from a top of the set of stairs S. As can be seen, further features of the frame 60 are of use when the support apparatus is configured as the stairwell platform 101. The frame 60 further comprises a support member in the form of lateral prop 70 which is extendably mounted at a lateral side of the frame 60. In this example, the frame 60 comprises a pair of lateral props 70. Each lateral prop 70 can be extended to stabilise the stairwell platform 101 away from a wall of the set of stairs S. When not required, the lateral props 70 can be slidably received within the frame 60 so as to reduce a size of the frame 60 and the support apparatus 1, 101 during maneuvering.

The frame 60 further comprises a lip portion 72. In this example, the frame 60 comprises a lip portion 72 at each end thereof. Thus, either end of the frame 60 can be supported directly on a step, typically a top step, of the set of stairs S via the lip portion 72. In some examples, the lip portion has defined therein a plurality of holes 73 for mounting the lip portion 72 to the set of stairs S. Thus, the lip portion 72 can be secured to the set of stairs S for safety and stability, for example with screws. It will be understood that although the pair of stairwell platform legs 110 are mounted at one end of the frame 60, there need be no legs mounted at the other end of the frame 60 because the other end of the frame 60 can be supported on the top step via the lip portion 72.

Figure 8:
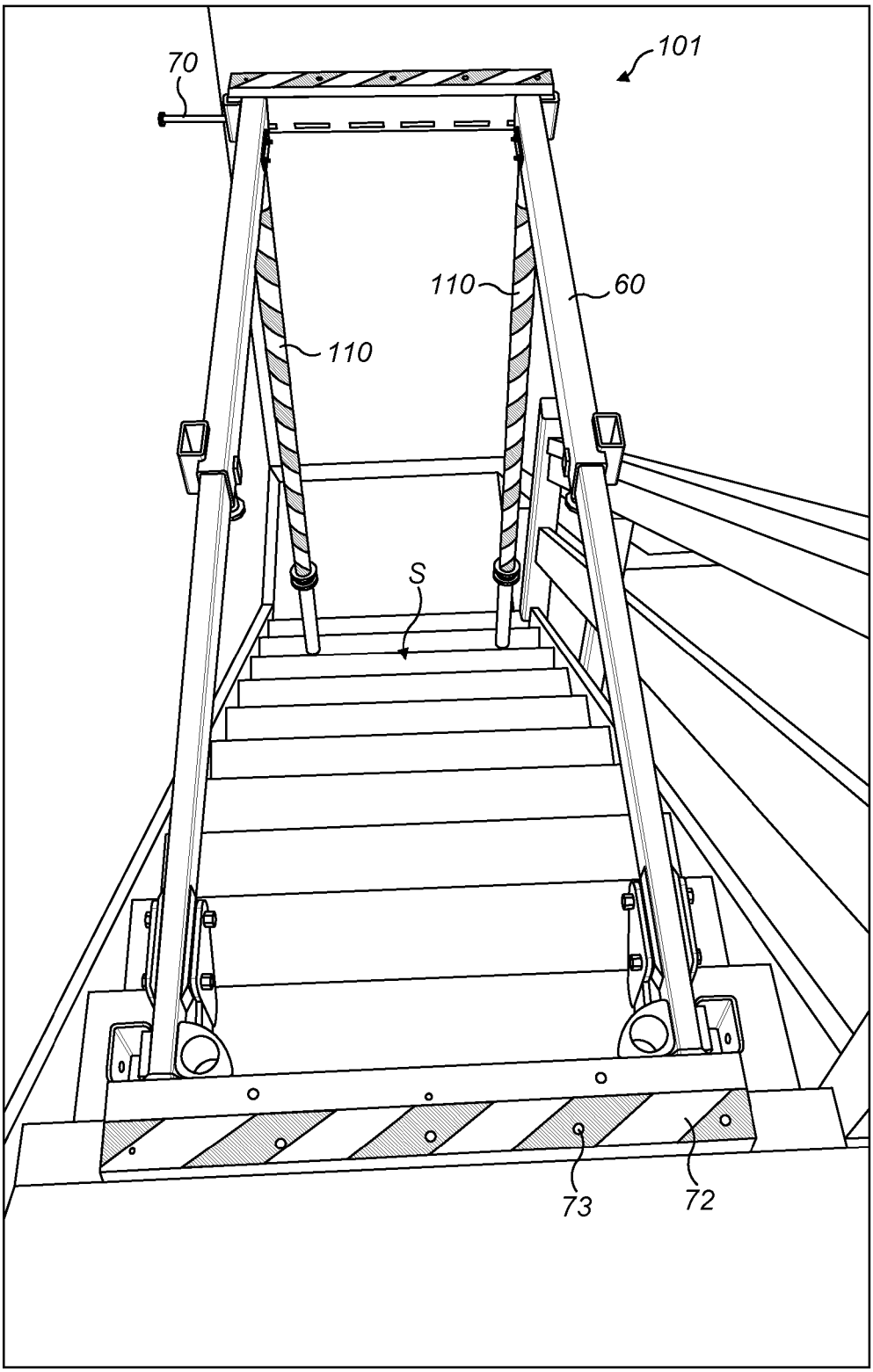
FIG. 8 is a further illustration of the further support apparatus of FIG. 7.

FIG. 8 is a further illustration of the further support apparatus of FIG. 7, viewed from the top of the set of stairs S. FIG. 8 clearly shows the holes 73 defined within the lip portion 72 for mounting the lip portion 72 of the frame 60 to the set of stairs S, for example using a screw fastening.

Figure 9:
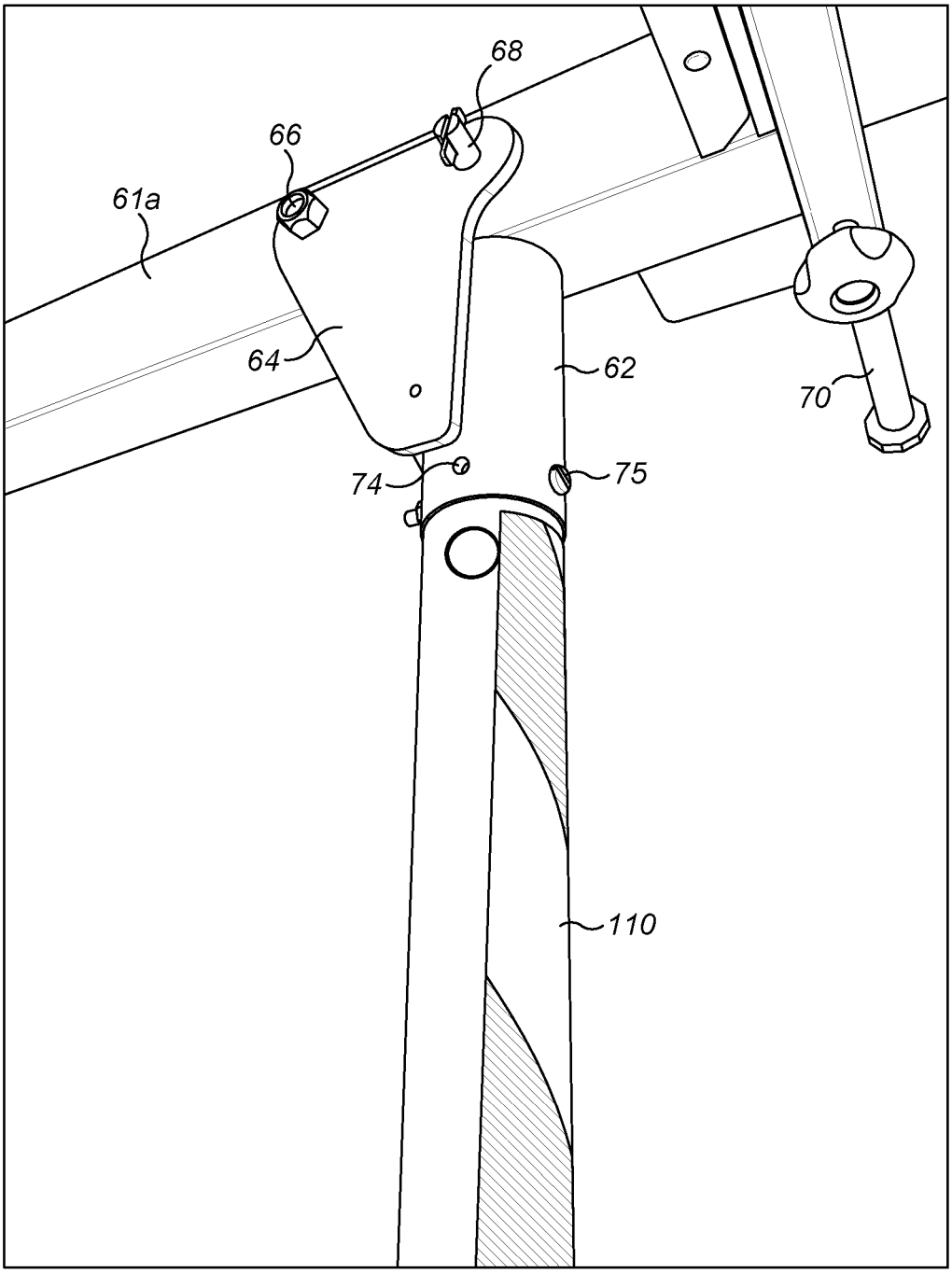
FIG. 9 shows a detail view of a leg bracket for use with the support apparatus as shown in any of FIGS. 1 to 6 or the further support apparatus as shown in FIGS. 7 and 8.

FIG. 9 shows a detail view of a flange plate for use with the support apparatus as shown in any of FIGS. 1 to 6 or the further support apparatus as shown in FIG. 7 or 8. The flange plate 64 and the collar 62 are substantially as described with reference to FIG. 5 hereinbefore. As can be seen, the locking pin 68 for securing the flange plate 64 and the collar 62 in place against the first portion 61*a* of the frame 60 is a drop-nose pin for easy insertion and securement of the locking pin 68. As can be seen in detail in FIG. 9, the collar 62 has defined therein a plurality of holes 74, such that a leg locking pin 75 can be inserted through a pair of opposing holes 74 and through holes defined in an upper end of the legs, in this case the stairwell platform legs 110 to secure the legs 110, 40*a*, 40*b* in place at the collar 62. The leg locking pin 75 is also used similarly to the pin connector 54 in order to set a rotational angle of the legs 110, 40*a*, 40*b*. It will be understood that in this example, the angle of the stairwell platform legs 110 makes no difference to the operation of the stairwell platform 101.

Figure 10:
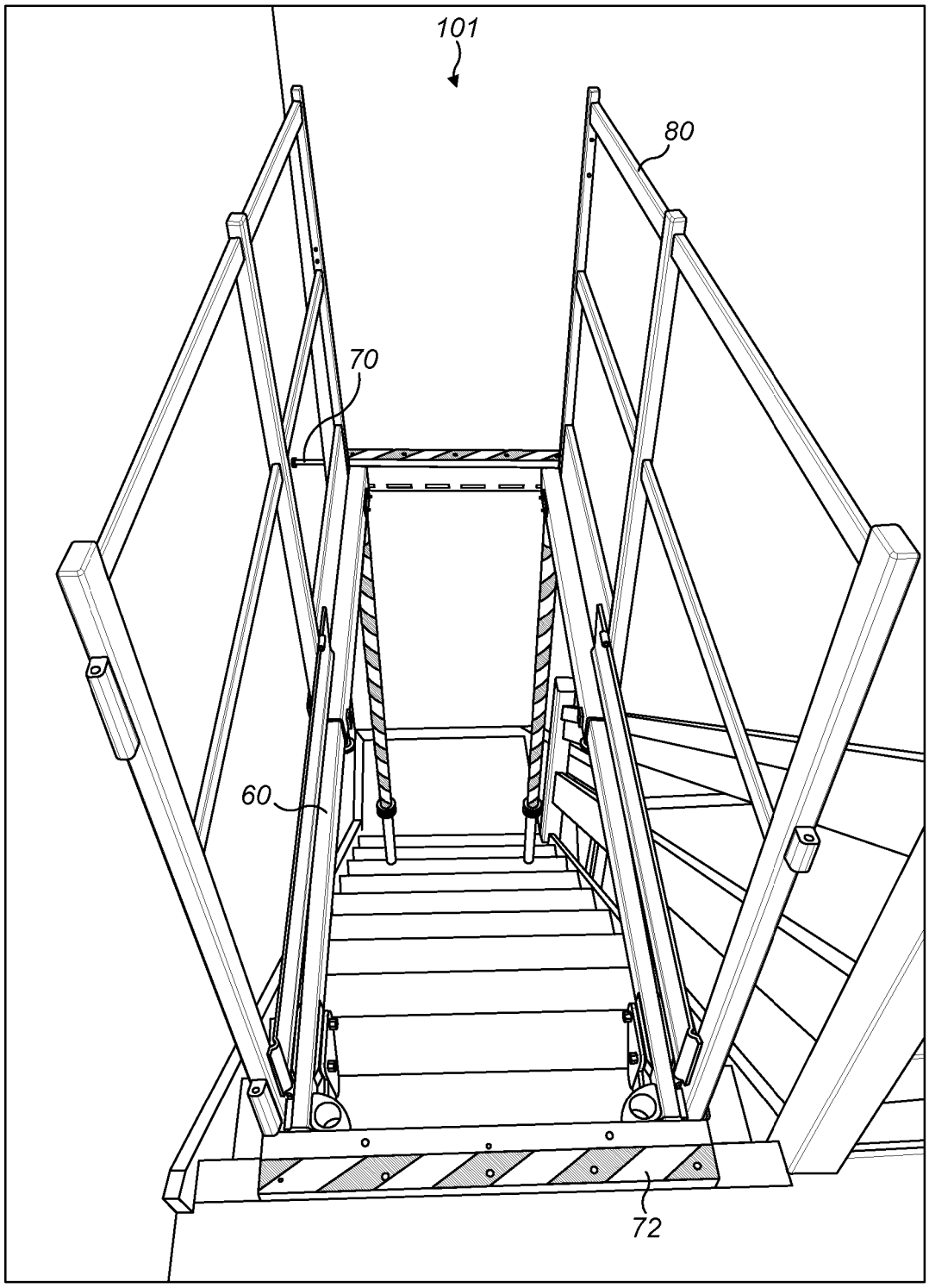
FIG. 10 is an illustration of the further support apparatus of FIG. 7, shown with a railing assembly provided thereon.
Figure 11:
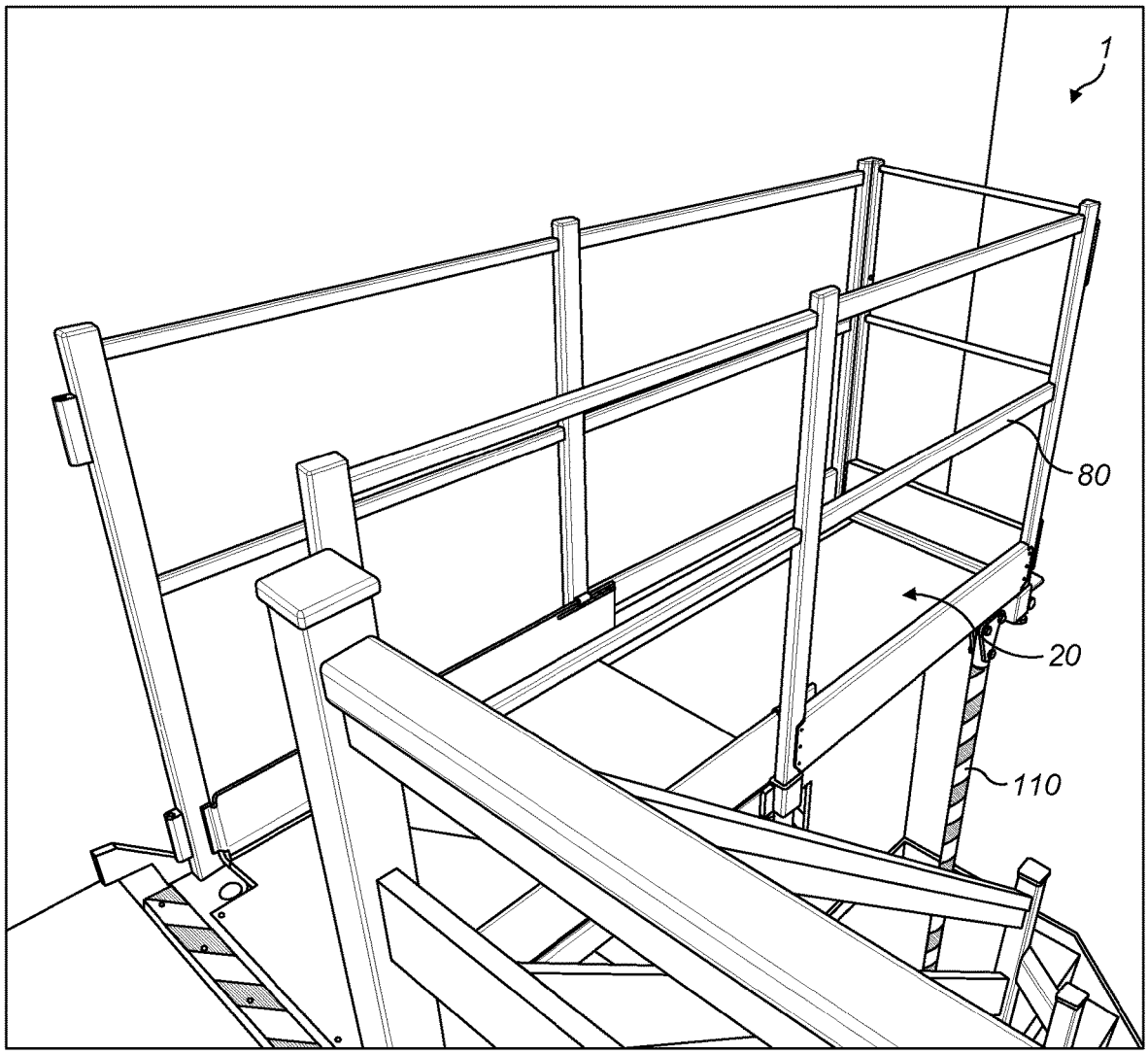
FIG. 11 is an illustration of the further support apparatus of FIG. 10, shown with a floor member provided thereon.
Figure 12:
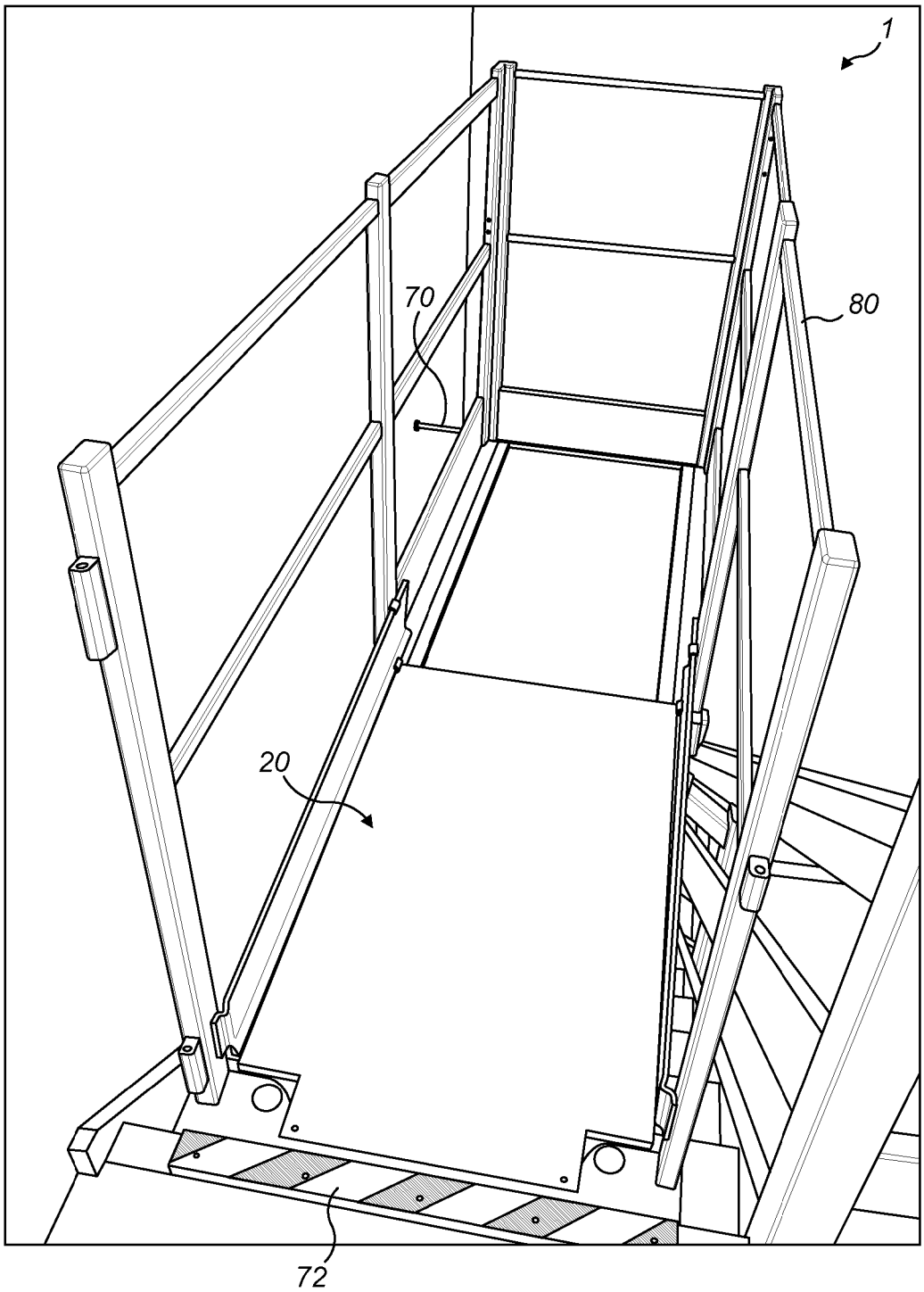
FIG. 12 is another illustration of the further support apparatus of FIG. 11.
Figure 13:
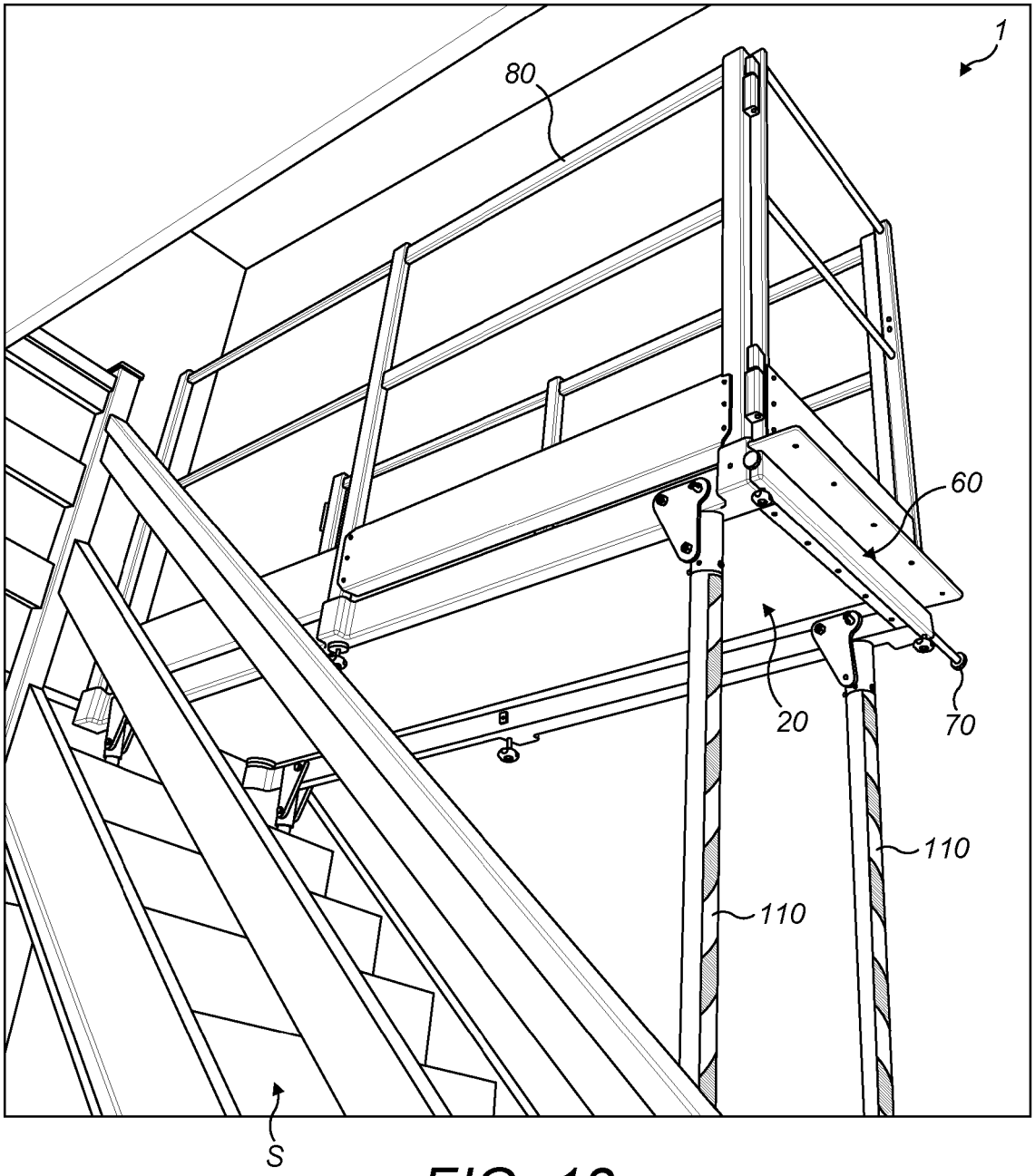
FIG. 13 is a further illustration of the further support apparatus of FIGS. 11 and 12.

FIG. 10 is an illustration of the further support apparatus of FIG. 7, shown with a railing assembly provided thereon. FIG. 11 is an illustration of the further support apparatus of FIG. 10, shown with a floor member provided thereon. FIG. 12 is another illustration of the further support apparatus of FIG. 11. FIG. 13 is a further illustration of the further support apparatus of FIGS. 11 and 12. Corresponding reference numerals are used to show corresponding components.

In summary, a support apparatus 1 for supporting a user in an elevated working position above a ground surface G comprises a frame 60 for supporting a floor portion 20 of the support apparatus and a plurality of leg members 40*a*, 40*b* mounted to the frame 60 for supporting the frame above the ground surface G. Each leg member has a foot portion 42 for engaging the ground surface G. Each leg member is rotatably mounted to the frame for rotation about a rotational axis which is substantially perpendicular to the width and the length of the frame and each leg member extends from the frame in a radial direction of the rotational axis, whereby the foot portion is offset from the rotational axis.

Throughout the description and claims of this specification, the words "comprise" and "contain" and variations of them mean "including but not limited to", and they are not intended to (and do not) exclude other components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The invention claimed is:

1. A support apparatus for supporting a user in an elevated working position above a surface, the support apparatus comprising:

a floor portion;

a frame for supporting the floor portion, the frame having a length and a width; and leg members mounted to the frame for supporting the frame above the surface, each leg member having a foot portion for engaging the surface, wherein each leg member is rotatably mounted to the frame for rotation about a rotational axis which is substantially perpendicular to the width and the length of the frame, and wherein each leg member extends from the frame in a radial direction of the rotational axis, whereby the foot portion is offset from the rotational axis, and wherein each leg member is rotatably mounted to the frame by the leg member being received within a collar, and the leg members are removably received within the collars, and wherein a rotational position of each leg member is fixed by engagement of a leg locking pin through holes in the collar.

2. The support apparatus as claimed in claim 1, wherein at least a portion of each leg member extends from the frame at an acute angle to the rotational axis and wherein that portion of the leg member is telescopically extensible, whereby telescopic extension of the leg member increases both the height of the frame above the ground surface and the offset of the foot portion from the rotational axis.

3. The support apparatus as claimed in claim 1, wherein each leg member is pivotally mounted to the frame about a pivot axis transverse to the rotational axis.

4. The support apparatus as claimed claim 1, wherein the foot portion of each leg member includes a wheel member and wherein the wheel member is spring mounted within the foot portion, whereby the weight of the user on the frame causes the foot portion to engage the surface in preference to engagement of the surface by the wheel member.

5. The support apparatus as claimed in claim 1, wherein are replaceable with alternative leg members.

6. The support apparatus as claimed in claim 1, wherein the collar is pivotally mounted to the frame about a pivot axis transverse to the rotational axis.

7. The support apparatus as claimed in claim 1, wherein the frame includes a lip portion at an end thereof for engagement with a stair.

8. The support apparatus as claimed in claim 1, wherein the frame is telescopically extensible to increase the length.

9. The support apparatus as claimed in claim 8, wherein the frame includes a railing assembly having a railing length and that is telescopically extensible to increase the railing length with extension of the frame.

10. A kit of parts for forming a support apparatus as claimed in claim 1.

* * * * *